US005582325A

United States Patent [19]

Janier

[11] Patent Number: 5,582,325

[45] Date of Patent: Dec. 10, 1996

[54] PORTABLE GOLF BALL DISPENSER

[75] Inventor: Jean-Louis Janier, Lons-le-Saunier, France

[73] Assignee: Annick Janier, Lons Le Saunier, France

[21] Appl. No.: 424,396

[22] PCT Filed: Oct. 26, 1993

[86] PCT No.: PCT/FR93/01047

§ 371 Date: Jun. 8, 1995

§ 102(e) Date: Jun. 8, 1995

[87] PCT Pub. No.: WO94/09867

PCT Pub. Date: May 11, 1994

[30] Foreign Application Priority Data

Oct. 26, 1992 [FR] France ..... 92 13071

[51] Int. Cl.[6] ..... A63B 57/00; B65H 3/32

[52] U.S. Cl. ..... 473/137; 221/250; 221/263; 221/283; 221/295; 221/185

[58] Field of Search ..... 221/185, 196, 221/247, 248, 249, 250, 263, 276, 283, 303, 306, 288, 289, 295; 273/320, 162 E, 201; 294/19.2

[56] References Cited

U.S. PATENT DOCUMENTS 1,940,321 7/1930 Pagett .
2,955,823 10/1960 Chanko ..... 221/289 X
3,599,983 8/1971 Melton .
4,146,232 3/1979 Stone ..... 273/201
4,796,893 1/1989 Choi ..... 273/201

FOREIGN PATENT DOCUMENTS 1501563 11/1967 France .
2616673 12/1988 France .

*Primary Examiner*—William E. Terrell
*Assistant Examiner*—Dean A. Reichard
*Attorney, Agent, or Firm*—Oliff & Berridge

[57] ABSTRACT

Distributor of the type comprising ball storing means and an articulated arm supplying a ball to the striking area. According to the invention, the ball storage means consists of a prismatic housing including, adjacent to each of its ends, supporting devices causing the bottom thereof to slope downwards in the direction of its open downstream end, which delimits an outlet for the passage of only one ball, its arm being articulated about a pivot pin in the housing. The distributor comprises a longitudinal chute, the upstream end being longitudinally closed, but having an opening for the distribution of a ball, while the upstream end is configured in the shape of a scoop for seizing a ball. Spring return means are placed between the housing and the arm to bring said arm into a substantially vertical position, once a ball is released.

9 Claims, 4 Drawing Sheets

PORTABLE GOLF BALL DISPENSER

BACKGROUND OF THE INVENTION

In the practice of golf, one of the most frequently repeated movements is that executed for positioning or picking up the ball. In the practice area, that is to say in the area where the movements involved in play are learnt or improved, and where each player exercises by driving off several tens of balls in succession, the positioning of each of the balls on a mat or on a tee needlessly increases the fatigue of the player and above all distracts him and quite often causes him to lose his positional references.

In order to alleviate this problem, ball dispensers have been proposed including a ball storage reservoir, means for selecting just one ball and means for conveying the ball selected to the driving area.

DESCRIPTION OF THE PRIOR ART

Current dispensers of the type of those described in French Patent No. 1,501,563 and in French Patent Application No. 2,616,673 are generally bulky, heavy and designed to be installed permanently close to the practice area. This drawback, associated with their high cost and with the complexity of their mechanisms, limits their use to organized ranges that have substantial financial means.

In practice, these are not very highly developed because since the majority of practice areas are out of doors, there is the risk of the mechanism of such dispensers being damaged by the weather.

U.S. Pat. Nos. 3,599,983 and 1,940,321 made known ball dispensers including a storage housing with an opening, means allowing just one ball to pass through this opening, and an arm articulated close to this opening and forming a dispensing chute. The downstream end of this chute has an opening in its bottom for dispensing the ball, whereas its upstream end is associated with sprung standing-up means and is equipped with a scoop for taking hold of a ball.

The first device can be used in a fixed position and has the drawbacks already indicated. The second device can be moved around but exhibits a lack of stability, a small storage capacity and allows its owner to take a certain number of balls away from the practice area with him.

This is a major drawback because since the use of the practice area is communal and balls belonging to the installation are used, any borrowing of balls with any device whatsoever causes a reduction in the available stock and, through the borrowed balls being replaced, leads to an increase in the operating costs.

Finally, most of the current devices regardless of their type have the drawback of always placing the ball in the same location whereas, as is known, depending on the length of the drive, this ball has to be placed forward or backward of a mean reference position. As a result, for long or short drives, the player has to adjust the position of the ball manually, or with his club, thus forcing him to take stock of his marks again, and distracting him.

SUMMARY OF THE INVENTION

The object of the invention is to alleviate these drawbacks by supplying a portable dispenser which is lightweight, small, inexpensive, easy to use, of simple operation, and positions the ball accurately, while being easy to adjust as a function of the length of the drive in order to give automatic dispensing which does not distract the player and allows him to remain in position.

In this dispenser, the storage means consist of a prismatic housing which, including, close to its respectively upstream and downstream ends, means resting on the ground and on a support, giving its bottom a longitudinal inclination in the direction of its downstream end, forms a housing which is open at the top and at its downstream end and has longitudinal walls having a height less than that of a ball and extending downstream beyond its bottom to serve as the articulation for the arm, while this arm, forming a cover and capable of being folded back against the housing is composed, on the one hand, of the chute located in the extension of the outlet opening delimited in the housing by a transverse internal wall and, on the other hand, and beside this chute, of a wall the downstream free edge of which constitutes a lever which, through use of a club, can be used to make the arm tilt into its ball dispensing position, and constitutes a guide for positioning the club.

When this dispenser is put in position, close to the driving area, and is set up so that when its chute is in the dispensing position, the dispensing opening formed at the free end of this chute coincides with the position which the ball is to occupy, the dispenser is brought into use by placing at least about ten balls in its housing. Prior to each drive, the player then only has to tilt the chute forming the arm in order to bring it from its substantially vertical position into the dispensing position. This movement is carried out by means of the club, which avoids the player having to bend down. During this pivoting, the scoop-shaped part of the chute takes a ball from the storage housing, and allows this ball to descend under gravity as far as the dispensing opening. During this movement, the wall of the bucket forms a shutter which prevents another ball from entering the chute. As soon as the ball located in the chute reaches the dispensing opening and, from there, comes to rest on the ground or a tee, the means for returning the chute stands the latter back up, thus freeing the area of play and continuing to fulfill the function of closing off the outlet passage of the housing. It should be noted that all these movements are carried out very easily with the aid of the club and without the player having to alter his marks, that is to say having to alter his position with respect to the ball, which allows him to progress more rapidly in improving the movement in question.

Moreover, and this is a very appreciable result, the sliding of the club over the wall forming an operating lever and against the edge of the chute, orientates this club so that when it leaves the dispenser it is in the ideal position for driving, which speeds up the learning process.

In order to modify the position in which the ball is dispensed with respect to the mean driving position, while benefiting from automatic dispensing, all that is required is to shift the whole dispenser sideways, this being all the more easy as it is lightweight and easy to adjust.

Finally, the dimensions of the housing allow it to accomodate a certain number of balls, generally between 17 and 18, but do not allow it to be closed again by means of the cover formed by the arm as long as it contains a ball, which prevents it from being used to take balls away from the practice area.

In one embodiment of the invention, its downstream means for resting on the ground interact with holding spaces projecting vertically from one of the ends of a plate for positioning relative to the practice area mat, this plate at its other end, which is inserted under the mat, including upwardly projecting spikes.

This simple arrangement improves the accuracy with which the housing can be positioned with respect to the practice mat.

In another embodiment, its downstream means for resting on the ground interact with holding spaces projecting from the web of a rigid fork, the legs of which can be pushed into the ground after they have passed through the perforations in a small plate, this small plate forming one of the ends of a transverse arm made of an elastically deformable material which, at its other end, has an open ring for positioning a ball.

This flexible and deformable structure replaces the tee for players training directly on grass.

Other features and advantages will emerge from the description which follows with reference to the appended diagrammatic drawing representing one embodiment of the diameter according to the invention, by way of non-limiting example.

DESCRIPTION OF THE PREFERRED EMBODIMENTS

Figure 1:
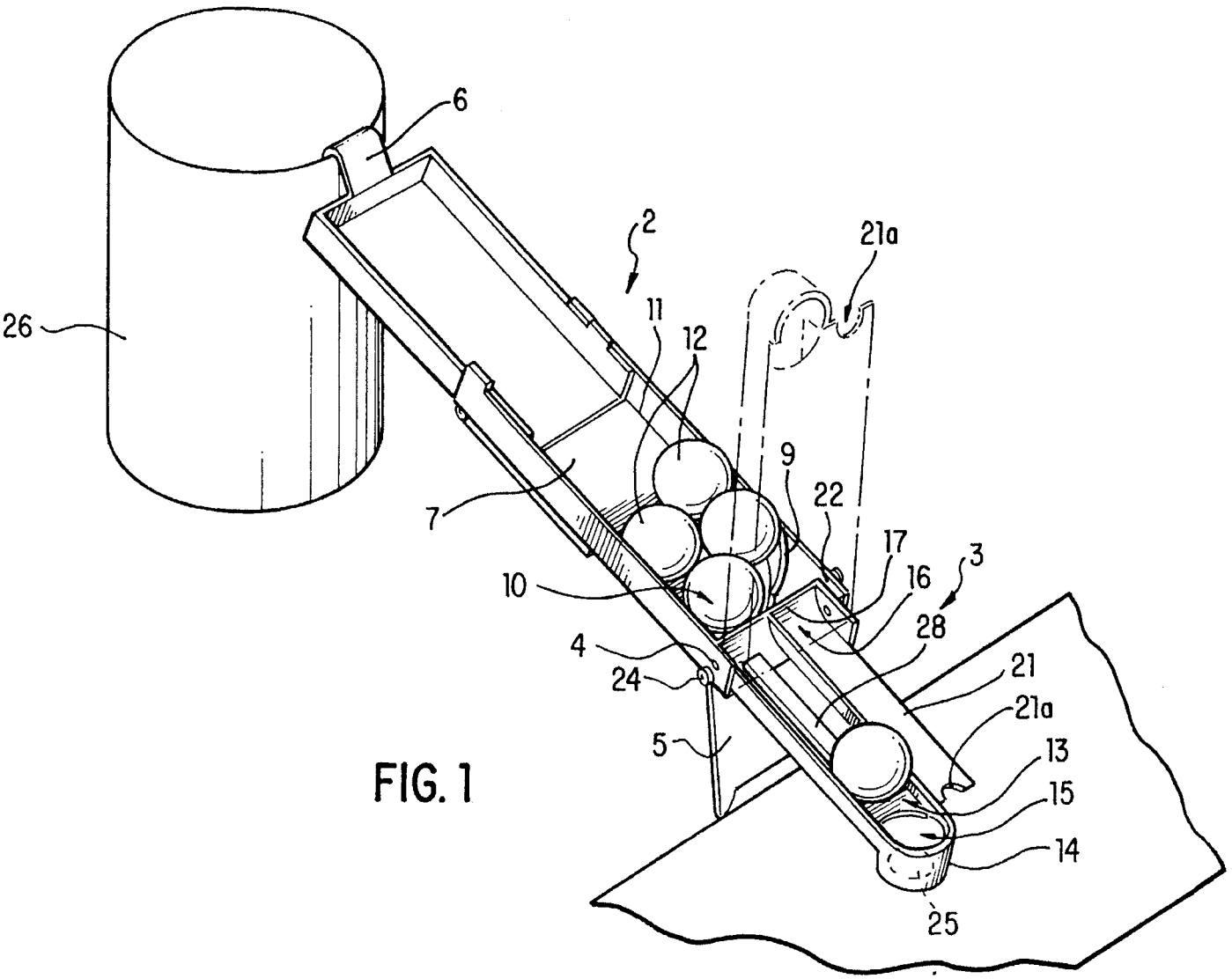
FIG. 1 is a perspective view showing one embodiment of the dispenser when it is in the dispensing and use position.

In general, this dispenser is composed of a prismatic housing denoted by the reference 2, of an arm 3 articulated, about a transverse axis embodied by pivots 4, to the housing 2 and of supporting means comprising a downstream underframe 5 and an upstream hook 6.

Figure 3:
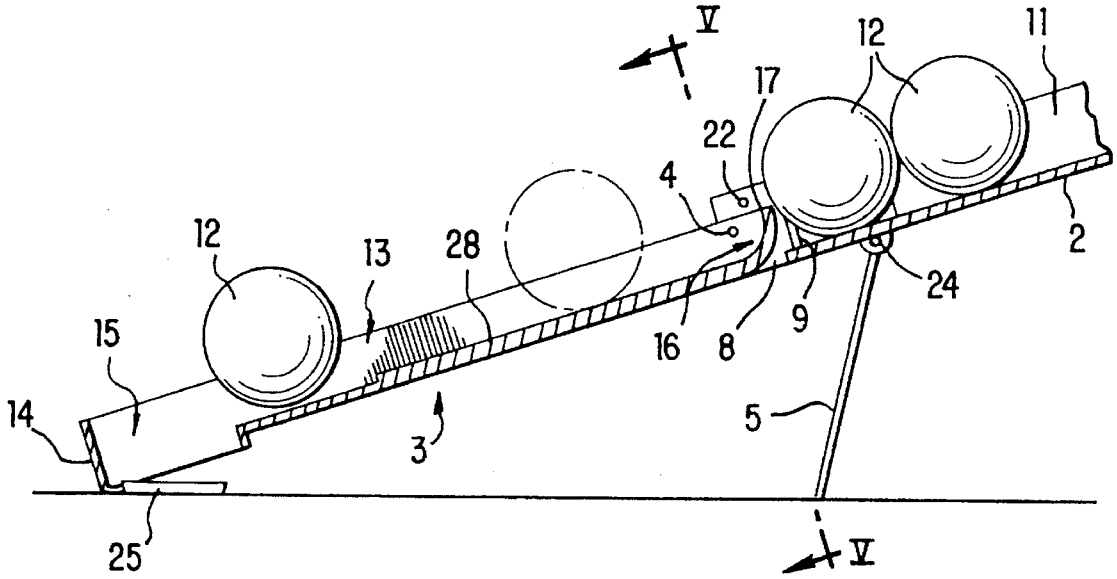
FIGS. 3 and 4 are part views in longitudinal section of the dispenser showing it when it is respectively in the dispensing position and in the standby position.
Figure 4:
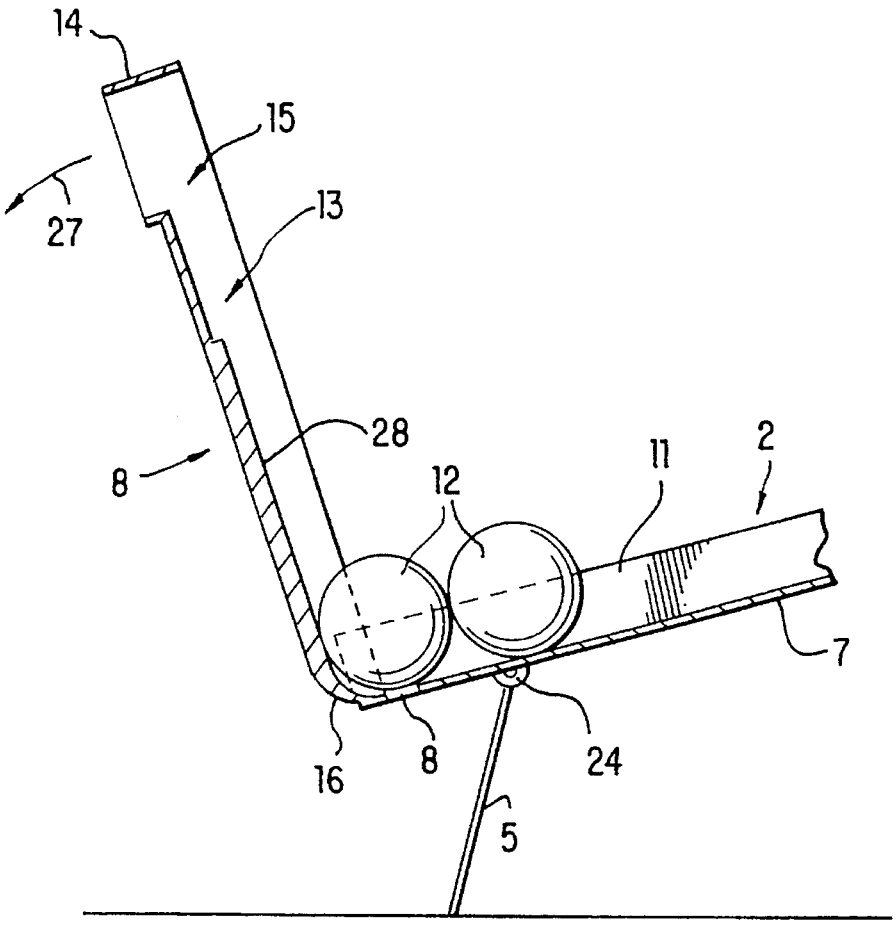

The housing 2 which, in the embodiment represented, is composed of two telescopic elements, has the overall shape of a parallelepipedal housing, open at the top and longitudinally, at its front end. At this end, and as FIGS. 3 and 4 show in more detail, its bottom 7 has a cutout 8 to allow the free rotation of the corresponding end of the arm 3. Close to this cutout 8 the housing 2, as shown in FIG. 1, has an internal wall 9 inclined transversely and directing the balls 12 towards an outlet opening 10. The longitudinal walls 11 of the housing have a height less than that of a ball 12 and are separated by a distance greater than that of a ball, in order to form a receptacle which can accommodate two rows of balls and, for example, about 18 balls.

The arm 3, which is articulated about pivots 4 to the lateral walls of the housing 2, forms a cover which can be folded back against the housing. In the extension of the outlet opening 10 it has a chute 13 for guiding the balls 12. At its free and downstream end with respect to the housing, this chute 13 is closed off longitudinally by a half ring 14 delimiting an opening 15 coinciding with an opening made in its bottom. Of course, the opening 15 has a diameter slightly greater than that of a ball 12 so as to allow this ball to pass through it freely.

At its other end, the chute 13 is shaped like a scoop 16 by means of the transverse wall 17 of the arm 3, which wall is in the shape of an arc of a circle of center coincident with the pivot 4 by which the arm is pivoted on the housing 2. When the arm 3 is in the shut off position shown in FIG. 4, the free edge of the scoop 16 is in the extension of the bottom 7 of the housing 2 and extends under the awaiting ball 12.

The articulation by means of which the arm 3 is articulated with respect to the housing 2 is associated with return means capable of returning the arm from its dispensing position represented in thick line in FIG. 1 to its standby position in which it closes off the outlet passage, represented in chain line in the same figure.

Figure 5:
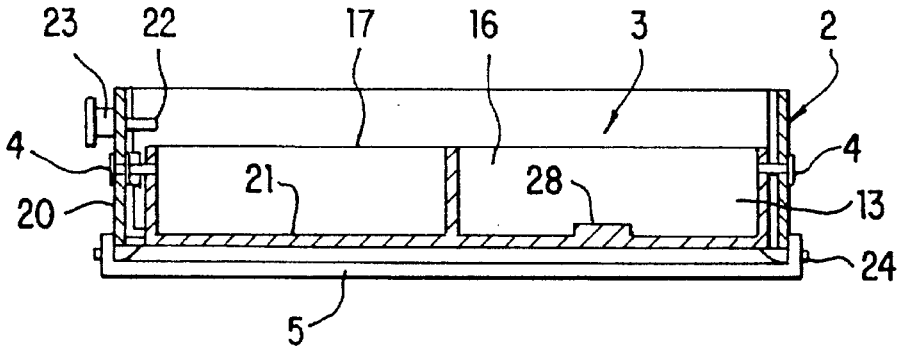
FIG. 5 is a transverse section on V—V of FIG. 3.

In one embodiment and as shown in FIG. 5, the return means consist of a torsion spring 20 located around one of the pivots 4 and one of the ends of which is hooked onto the housing 2 while the other end is hooked onto the arm 3.

This articulation is also associated with means for holding the arm 3 in position in the standby position, which means, in this embodiment, consist of a retractable finger 22 located in the path of the arm 3 and the body 23 of which is fixed to the housing 2, close to the pivot 4.

The support means of the housing 2 consist of a downstream underframe 5 articulated about the underframe pivot 24 to the housing 2 and of a hook 6 projecting from the upstream part of the housing 2, that is to say from that part which is opposite the arm 3. This book is designed to interact with the upper edge or with the meshwork of a basket 26 generally used to supply balls to the players.

It is clear that the hook 6 may be replaced by an underframe of the same type as that of 5, but higher up, so that in the position of use as shown in FIG. 1, the housing assembly is inclined at least longitudinally, dropping down from the upstream part of the housing to its downstream part.

Advantageously, and to facilitate the accumulation of the balls 12 on the outlet opening 10 side, the downstream underframe 5 is lower on the side of this opening 10 than it is on the other side, in order to give the housing a transverse inclination.

It will be understood that it is very easy to position this dispenser so that the half ring 14 formed at the end of the chute 13, when the arm 3 is in the dispensing position, curls round a tee 25 or the area on which the ball is to be deposited.

Before exerting himself and assuming the driving position, the player has first of all to take at least about ten balls 12 from the container 26, and tip them into the housing 2. From then on, for each drive, the player then need only cause the arm 3 to pivot into the dispensing position represented in solid line in FIG. 1, using his club. To facilitate this operation the arm 3 is equipped, beside the chute, with a wall 21, the free end of which has a notch **21*a*** to form a means in which to hook the club.

As FIG. 4 shows, pivoting the arm 3 in the direction of the arrow 27 allows the scoop 16 to take up the first awaiting ball 12, becoming inserted between this ball and the next ball.

As soon as the ball is running down the chute 13, the arm 3 is held in the dispensing position by the weight of this ball 12, which position it maintains until the ball, reaching its downstream end, escapes through the opening 15 and comes to rest on the tee 25. From that moment on, the arm 3, freed of the weight of the ball, is returned by the torsion spring 20 to its standby position delimited by the retractable finger 22.

This pivoting allows the chute 16 to become inserted under the next ball, thus getting ready to take hold of another.

It should be noted that the bottom of the chute, in its central part and over the part close to its pivot 4, has a rib 28 allowing the ball to roll directly on it and rapidly acquire high speed at the beginning. This outgrowth is interrupted before the ball reaches the opening 15 so that the ball comes into contact with the edges of the chute 13 and so that, therefore rolling on a circle of small diameter, it decelerates its speed, improving the accuracy with which it is positioned.

Through the club coming into contact with the wall 21, and also against the upstream edge of the chute, this dispenser also positions this club during the manoeuvre of lowering the arm. As a result, at the end of the dispensing of a ball, not only has the player been able to preserve his position references but his club is itself also positioned for the next drive, just behind the ball.

The dispenser may easily be shifted sideways to suit the needs of the player and, for example, to allow long or short drives requiring a ball position forwards of or behind the usual mean position.

Figure 2:
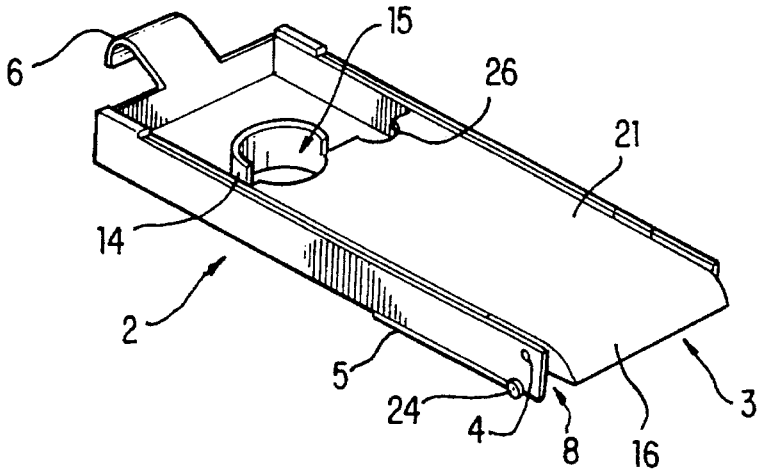
FIG. 2 is a perspective view of the dispenser showing it when it is in the transportation position.

After use, and as FIG. 2 shows, the housing 2 is shortened, by retracting its two elements telescopically, and the arm 3 is folded back against the housing and locked in this position. The dispenser assembly then constitutes an assembly of small bulk which can easily be placed in a pocket.

Since the folding back movement is possible only if the storage magazine contains no more balls, the housing cannot be used for taking balls away from the practice area.

In a variant embodiment, the articulated arm 3 is also telescopic so as to free even more of the driving area when it is in the substantially vertical standby position in which it closes off the outlet opening.

Figure 6:
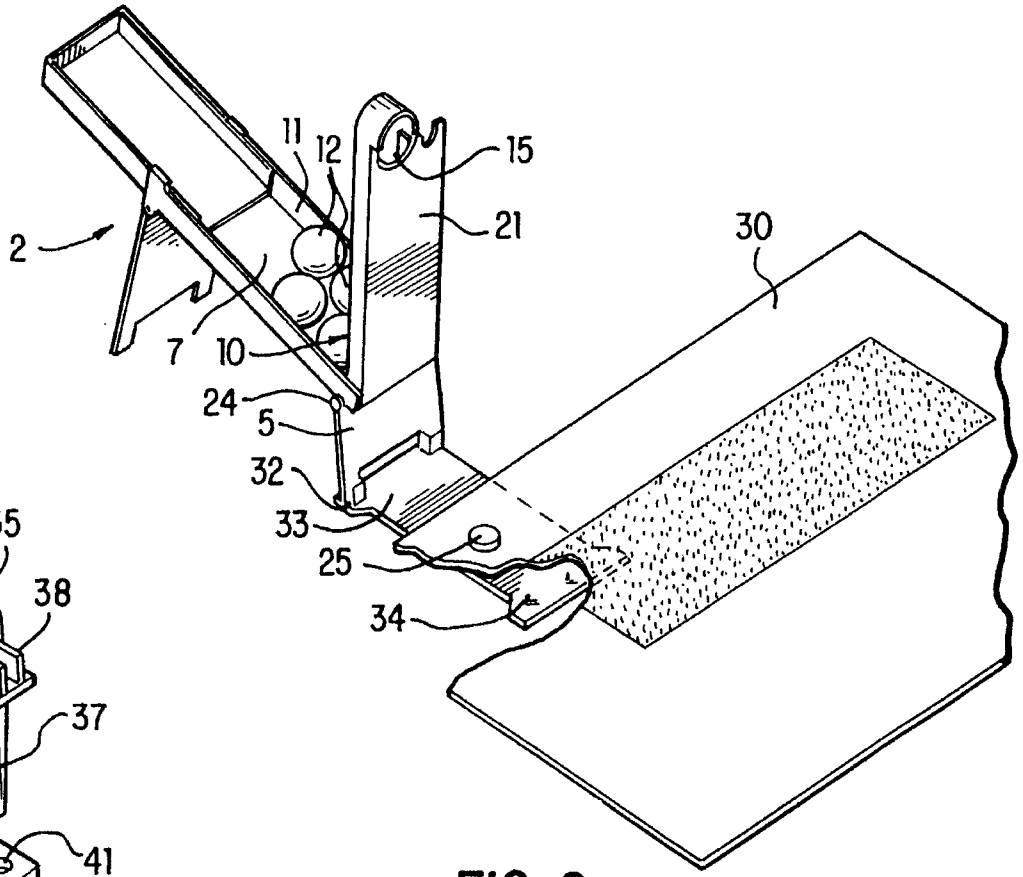
FIG. 6 is a perspective view showing the dispenser when it is interacting with a positioning plate.

FIG. 6 shows that to make it easier to position the dispenser with respect to a rubber mat 30 on a practice area, its underframe 5 interacts with holding spaces 32 formed at one of the ends of a plate 33 made of a rigid material, and for example a synthetic substance. The other end of the plate is equipped with spikes 34 projecting upwards and pushing under the mat 30 after the end in question of the plate 33 has been located underneath.

With this plate 33, the position given to the dispenser is stable, but can nevertheless be altered to suit the play.

Figure 7:
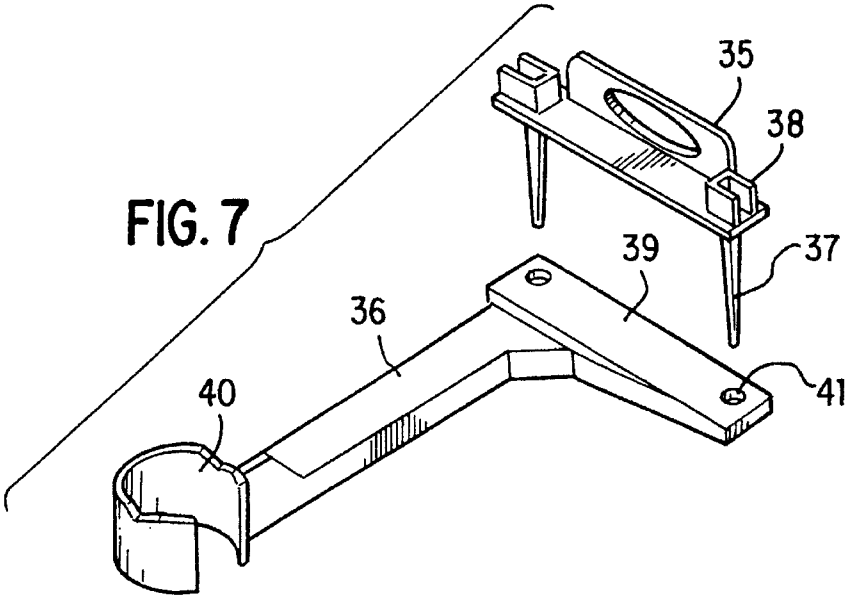
FIG. 7 is a perspective view of a structure for positioning the ball on grass interacting with the dispenser.

FIG. 7 shows an accessory making it possible to use the ball dispenser on a grass practice area which therefore does not have a reference surface like concrete practice areas do. This accessory is composed of a positioning fork 35 and of a transverse arm 36. The fork 35 is made of a rigid material and includes, projecting on either side of its web, namely downward, legs 37 which can be pushed into the ground and, at the top, two spaces 38 for holding the underframe 5 of the dispenser.

The arm 36 is made of an elastically deformable material such as rubber or elastomer. It comprises, on the fork side, a small plate 39 equipped with perforations 41 through which the legs 37 can pass and, on the other side, an open ring 40 for positioning a ball, the ring having an outside diameter which is smaller than that of a ball.

In use, the arm 36 is placed on the grass and is fastened by the fork 35 pushed into the ground, while the underframe 5 of the dispenser is held in the spaces 38.

Under these conditions, the pivoting of the arm 3 of the dispenser conveys the ball 12 to the ring 40 which acts in lieu of the tee 25. During driving, the club strikes the ball above the split part of the ring 40. If it touches the ring 40, the elasticity of the arm 36 returns this arm to its starting position.

I claim:

1. A portable golf ball dispenser of the type including storage means with an outlet opening allowing just one ball through, and an arm articulated about a pivot close to the opening and forming a dispensing chute, the downstream end of which chute is closed off longitudinally but is equipped with a bottom opening for dispensing a ball, and the upstream end of which is associated with a means with a spring for standing it up vertically, and is equipped with a scoop for taking hold of a ball, wherein said storage means comprises a prismatic housing which includes, close to its respectively upstream and downstream ends, support means resting on a playing surface and on a support, giving a bottom ball supporting surface of said housing a longitudinal inclination in the direction towards its downstream end, forms a housing which is open at the top and at its downstream end and has longitudinal walls having a height less than that of a ball and extending downstream beyond its bottom ball supporting surface to serve as the articulation for the arm, while this arm, forming a cover and capable of being folded back against the housing comprises, first, the chute located in alignment with the outlet opening of said storage means delimited in the housing by a transverse internal wall and, second, and located beside said chute, of a wall the downstream free edge of which constitutes a lever which, through use of a club, can be used to make the arm tilt into a ball dispensing position, and which comprises a guide fo positioning the club.

2. The dispenser as claimed in claim 1, wherein the pivot via which the arm pivots on the housing is associated with a retractable means for holding the arm in a substantially vertical return position, in which position it closes off the outlet opening

3. The dispenser as claimed in claim 1, wherein the support means of the housing consist, upstream, of a hook projecting vertically and outward from a transverse wall of said housing and capable of interacting with a container containing balls and, downstream, of an underframe.

4. The dispenser as claimed in claim 1, wherein the support means of the housing, located downstream, are shorter on a transverse side of said housing including the outlet opening, so as to incline the housing transversely to said side.

5. The dispenser as claimed in claim 1 wherein said scoop of the arm consists of a transverse wall which, closing the chute upstream, is bent into a circular arc of center coaxial with the pivot by means of which the arm pivots on the housing, the edge of this wall, when the arm is in the position for closing off the outlet passage, coming into alignment with the outlet opening of said storage means beneath an awaiting ball.

6. The dispenser as claimed in claim 1, wherein at least one of the elements comprising housing and arm is composed of two telescopic elements increasing its length when in use.

7. The dispenser as claimed in claim 1, wherein a bottom surface of the chute includes, from downstream to upstream in the direction in which a ball runs, an acceleration zone delimited by a rib projecting from said bottom surface, and a deceleration zone without a rib in which side walls of said chute come into contact with a ball travelling in said chute.

8. The dispenser as claimed in claim 1 in combination with a positioning plate for positioning said dispenser relative to a practice area mat, wherein said downstream support means interacts with holding spaces projecting vertically from one of the ends of said positioning plate which is partially placed under said mat, this plate at its other end, which is inserted under the mat, including upwardly projecting spikes.

9. The dispenser as claimed in claim 1 in combination with a rigid positioning fork, wherein said downstream support means interacts with holding spaces projecting from a web of said rigid fork, a plurality of legs of which can be pushed into a soft playing surface after they have passed through perforations in a small plate, said small plate forming one of the ends of a transverse arm made of an elastically deformable material which, at its other end, has an open ring for positioning a ball.

* * * * *